United States Patent [19]

Coleman

[11] 4,124,167

[45] Nov. 7, 1978

[54] MATERIAL SPREADER FOR MOUNTING ON A VEHICLE

[76] Inventor: Robert E. Coleman, Box 344, Newton, Kans. 67114

[21] Appl. No.: 786,065

[22] Filed: Apr. 11, 1977

[51] Int. Cl.[2] ..... E01C 19/20

[52] U.S. Cl. ..... 239/673; 192/84 C; 74/243 DR

[58] Field of Search ..... 239/672–674; 192/84 C; 74/243 C, 243 DR

[56] References Cited

U.S. PATENT DOCUMENTS

| | | | |
|---|---|---|---|
| 2,295,472 | 9/1942 | Hokpins | 239/674 X |
| 2,988,368 | 6/1961 | Kerr | 239/674 X |
| 3,539,113 | 11/1970 | Tyler et al. | 239/673 |
| 3,586,145 | 6/1971 | Cunningham et al. | 192/84 C |
| 4,031,769 | 2/1976 | Kassing | 74/243 DR |

*Primary Examiner*—Robert W. Saifer
*Attorney, Agent, or Firm*—Edwin H. Crabtree

[57] ABSTRACT

A material spreader for spreading sand, salt or the like. The spreader is mounted on a vehicle or a trailer with the material being discharged from the rear. The spreader includes a fiberglass hopper and hopper housing with a stainless steel endless conveyor for reducing corrosion and wear. A spinner assembly, used for spreading the material, and the conveyor are driven by a variable speed engine. The engine controls the speed of the conveyor and spinner assembly independently of the speed of the vehicle.

8 Claims, 10 Drawing Figures

MATERIAL SPREADER FOR MOUNTING ON A VEHICLE

BACKGROUND OF THE INVENTION

This invention relates to a material spreader and more particularly, but not by way of limitation, to a spreader mounted on a vehicle or a trailer for spreading material in a given pattern on highways, roads, parking lots, or any other surface requiring material spread thereon.

Heretofore, there have been various types of material spreading equipment for spreading sand, salt, fertilizer or other materials. This type of equipment has generally been belt or chain driven from power takeoff systems attached to the vehicle's drive unit. There have also been different types of spreaders mounted on vehicles or trailers having independent power sources which by belt or chain drive are connected to endless conveyors, augers or the like, for discharging material therefrom.

U.S. Pat. No. 3,693,890 to Torrey, discloses a material spreader attachment for mounting at the rear of a conventional truck. The spreader includes a constant speed engine used for driving a material conveyor. A friction wheel rotates a distribution disc and by adjusting the friction wheel along its rotational axis, the speed of the disc and the material discharged therefrom is controlled.

The prior art spreading devices, while similar in some respects to the subject invention, do not disclose the combined structure of the invention nor do they provide the advantages derived therefrom.

SUMMARY OF THE INVENTION

The subject invention is lightweight, simple in construction and design, and requires only one man for loading, unloading and operating. The invention may be mounted on a conventional pickup, truck, trailer, or any type of pulling vehicle.

The spreader has a fiberglass hopper and hopper housing which is rugged in construction and provides longer wear life since it is non-corrosive to material such as salt and sand, which are used for spreading on a highway during ice and snow conditions. The spreader also uses a noncorrosive stainless steel link designed endless conveyor belt for extending the life of the conveyor.

The conveyor and a spinner assembly, used for spreading the material in a pattern on the highway surface, are driven by a conventional gasoline driven engine mounted on the rear of the hopper housing. By having a separate engine drive, the speed of the conveyor and spinner assembly can be controlled independently of the vehicle's engine. Also the spreader includes a clutch for disengaging the engine from the conveyor and spreader assembly.

The combination of the structure of the spreader provides for minimal downtime, longer life of the equipment and overall lower maintenance costs.

The material spreader includes a fiberglass hopper mounted in a fiberglass hopper housing. The housing may be mounted on a pickup, truck, trailer or any similar type of vehicle. A conveyor is mounted at the bottom of the hopper and extends outwardly through an opening in the rear of the hopper housing. The conveyor receives the material from the hopper for discharging it out the rear of the hopper housing. A material shoot is attached to the rear of the hopper housing and extends downwardly therefrom for receiving the material from the end of the conveyor. A spinner assembly is attached to the hopper housing and disposed vertically inside the shoot for receiving the material and discharging it in a pattern on the highway surface. An engine is mounted on the rear of the hopper housing and is attached to a clutch assembly. The clutch assembly in turn is attached to the spinner assembly and a gear box used for driving a drive drum attached to the conveyor.

The advantages and objects of the invention will become evident from the following detailed description when met in conjunction with the accompanied drawings which illustrate the preferred embodiments of the invention.

DETAILED DESCRIPTION OF THE DRAWINGS

Figure 1:
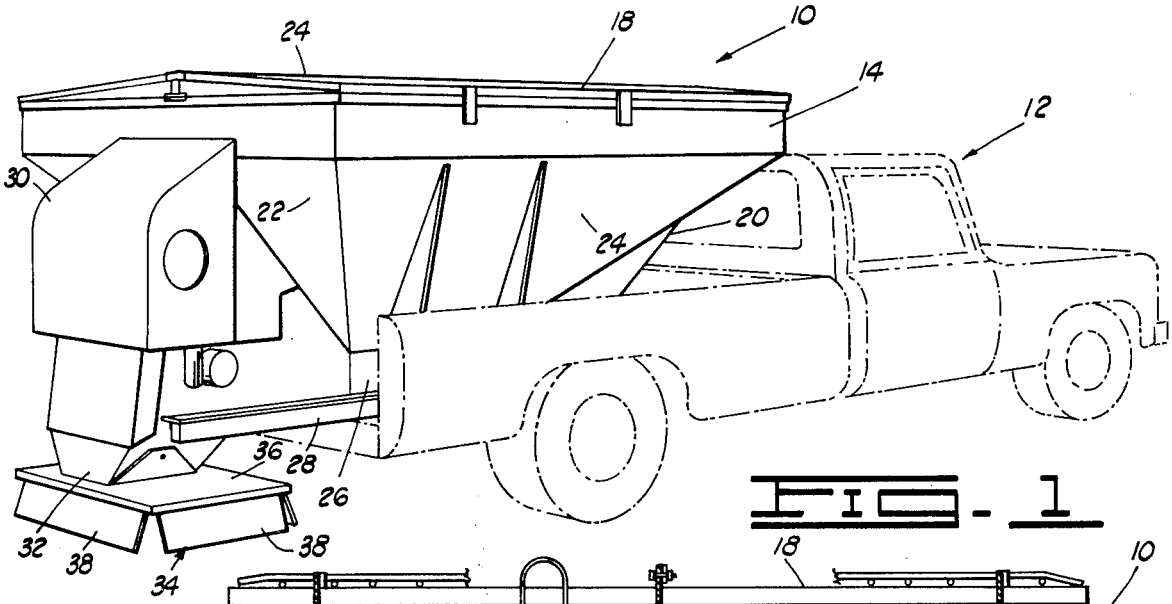
In FIG. 1 a perspective view of the spreader mounted on the rear of a pickup truck.

In FIG. 1, the material spreader for spreading sand, salt or the like, is designated by general reference numeral 10. The spreader 10 is mounted on the rear of a pickup 12. While the pickup 12 is shown, it should be appreciated that any type of vehicle having a flat bed or a trailer may be used for receiving the spreader 10 thereon. The spreader 10 includes a hopper housing 14, having a hopper 16 mounted therein and shown in cross sections in FIG. 3.

The hopper housing 14 includes an open top portion 18 for receiving the material to be spread therein. The housing 14 further includes a front portion 20, a rear portion 22, side portions 24 and a bottom portion 26. The bottom portion 26 includes a pair of parallel skids 28 attached thereto for supporting the spreader 10 on top of the flat bed of the pickup 12.

Figure 3:
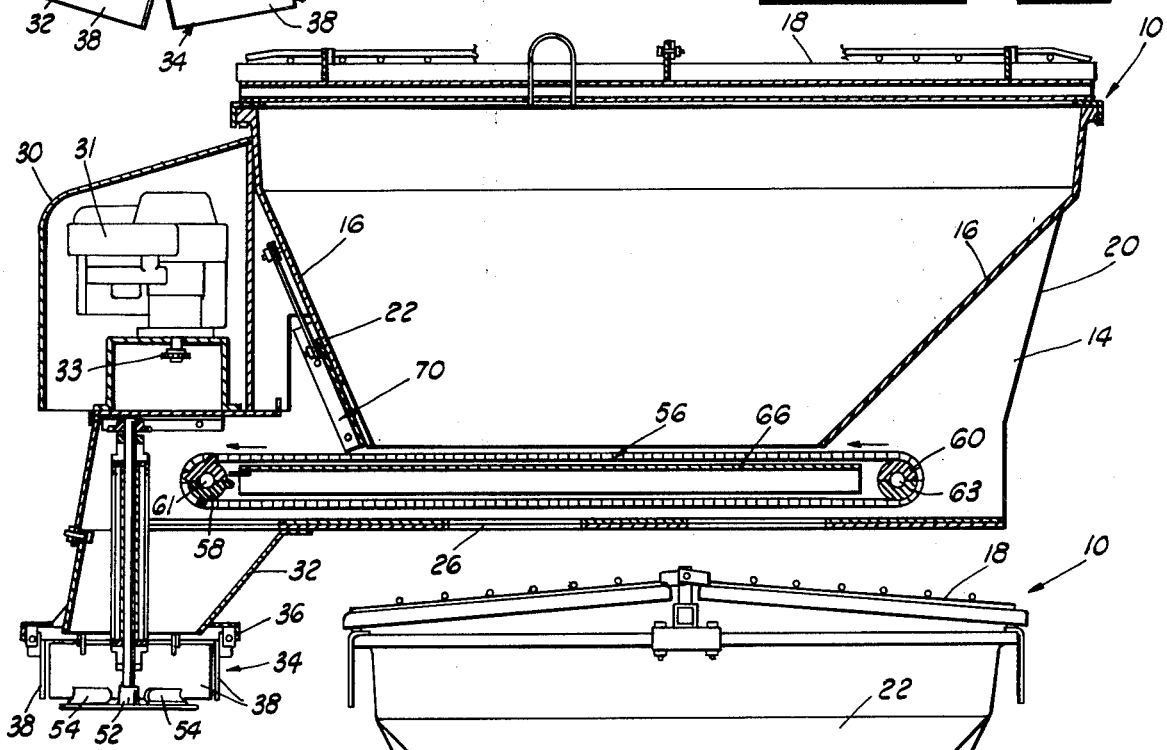
FIG. 3 is a side sectional view of the spreader.

Attached to the rear portion 22 of the housing 14 is a molded engine housing 30. Enclosed in the housing 30 is a variable speed engine 31 with an engine drive shaft 33 which are shown in FIG. 3. Attached to the rear of the bottom portion 26 of the housing 14 is a material shoot 32 which receives the material from one end of an endless conveyor disposed at the bottom of the hopper 16. Attached to the opening of the shoot 32 is a baffle assembly 34 having a baffle frame 36 with pivotly mounted baffle plates 38 attached thereto. By positioning the baffle plates 38 at an angle from the vertical, the material discharged from the shoot 32 is controlled in a desired pattern.

Figure 2:
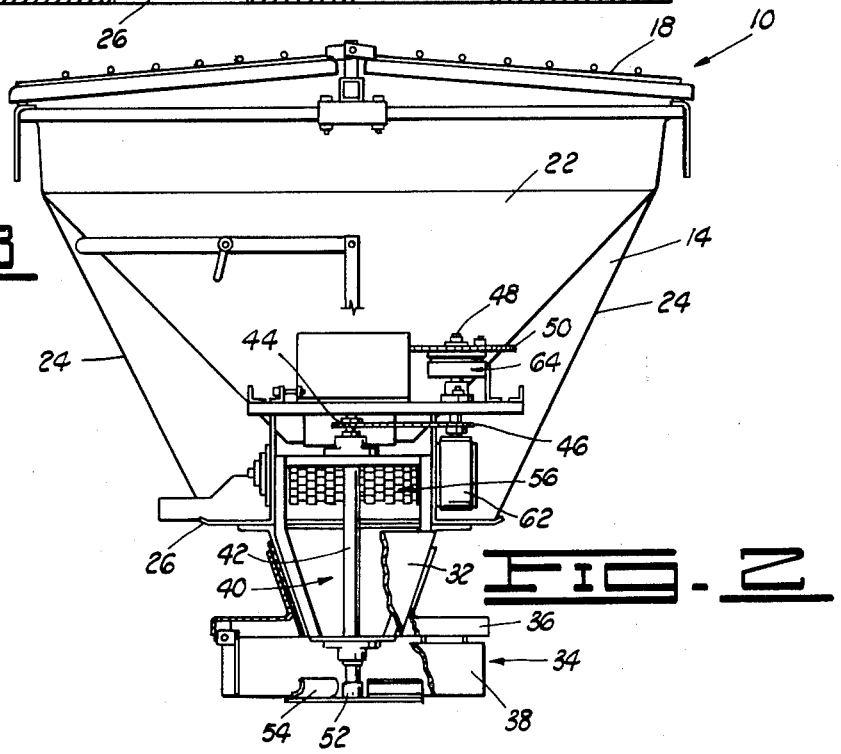
FIG. 2 is a rear view of the spreader.

In FIG. 2, a rear view of the spreader 10 is illustrated with a cutaway section of the shoot 32 exposing a spinner assembly 40. The spinner assembly 40 includes a vertically mounted spinner shaft 42. The shaft 42 is attached to a shaft sprocket 44 which is chain driven by a spinner drive sprocket 46. The spinner drive sprocket 46 is rotated by a clutch shaft 48. The clutch shaft 48 is driven by a chain driven clutch sprocket 50. The clutch sprocket 50 is driven by the drive shaft 33 of the engine 31 shown in FIG. 3. The spinner assembly 40 further includes an annular shaped disc 52 horizontally mounted at the lower end of the shaft 42. Mounted on top of the disc 52 are concaved shaped distribution cups 54.

The material in the hopper 16 is discharged on top of an endless conveyor 56. The conveyor 56 discharges the material into the shoot 32 where it falls onto the flat surface of the disc 52. The distribution cups 54 urge the material outwardly where it falls to the ground surface or hits the sides of the baffle plates 38.

While it cannot be seen in this view, the conveyor 56 includes a drive drum 58 and an idle drum 60 which are shown in FIG. 3. The drive drum 58 includes a drive shaft 61 which is attached at one end to a gear box 62. The gear box 62 is driven by the clutch shaft 48. The gear box 62 is used to reduce the speed of the engine 31 to the conveyor 56 via the clutch shaft 48.

The clutch shaft 48 has a clutch assembly 64 attached thereto which is electrically actuated by the battery of the engine 31. The battery is not shown in the drawings. The clutch assembly 64 is keyed to the clutch shaft 48 and when actuated engages the clutch sprocket 50 thereby rotating the sprocket 50 on the clutch shaft 48 for rotating the conveyor 56 and spindle assembly 40.

In FIG. 3, a side sectional view of the hopper housing 14 is illustrated showing the endless conveyor 56 disposed at the bottom of the sloping sides of the hopper 16. The conveyor 56 includes a horizontal frame 66 mounted below the upper portion of the conveyor 56. The conveyor 56 is made up of a series of corrosion resistant stainless steel links which ride on top of the horizontal frame 66 for receiving the material from the hopper 16 and discharging it out the rear portion 22 of the housing 14. The material is carried over the top of the drive drum 58 where it is discharged downwardly through the shoot 32.

In this view a conveyor gate assembly 70 can be seen disposed above the opening in the rear portion 22 of the hopper housing 14. By adjusting the gate assembly 70 vertically, the amount of material discharged on top of the conveyor 66 can be controlled. The gate assembly 70 is illustrated more clearly in FIG. 4.

Figure 4:
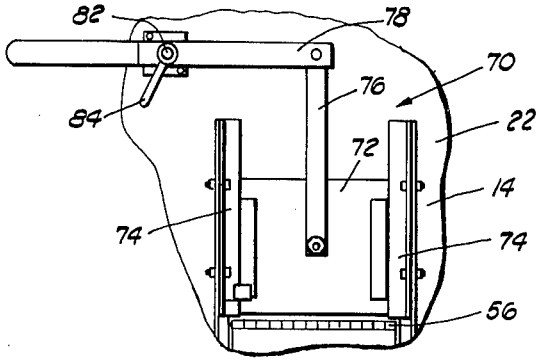
FIG. 4 is an enlarged view of a conveyor gate assembly.

In FIG. 4, part of the rear portion 22 of the hopper housing 14 can be seen with the gate assembly 70 having a sliding door 72 mounted vertically between door guides 74. The sliding door 72 is raised in the guides 74 by a link arm 76 attached to a handle 78 which pivots on a threaded bolt 82 secured by a threaded arm 84. By loosening the arm 84, the handle 78 can be used to raise the sliding door 72 to a desired position above the top of the endless conveyor 56. By adjusting the distance between the bottom of the door 72 and the top of the conveyor 56, the amount of material discharged on the conveyor 56 may be controlled.

Figure 5:
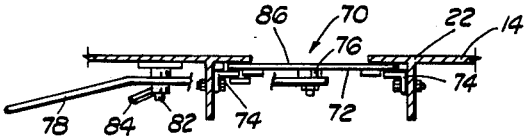
FIG. 5 is a top view of the gate assembly.

In FIG. 5, a top view of the conveyor gate assembly is shown. In this view the sides of the sliding door 72 can be seen disposed between the door guides 74 and the sides of an opening 86 in the rear portion 22 of the hopper housing 14.

Figure 6:
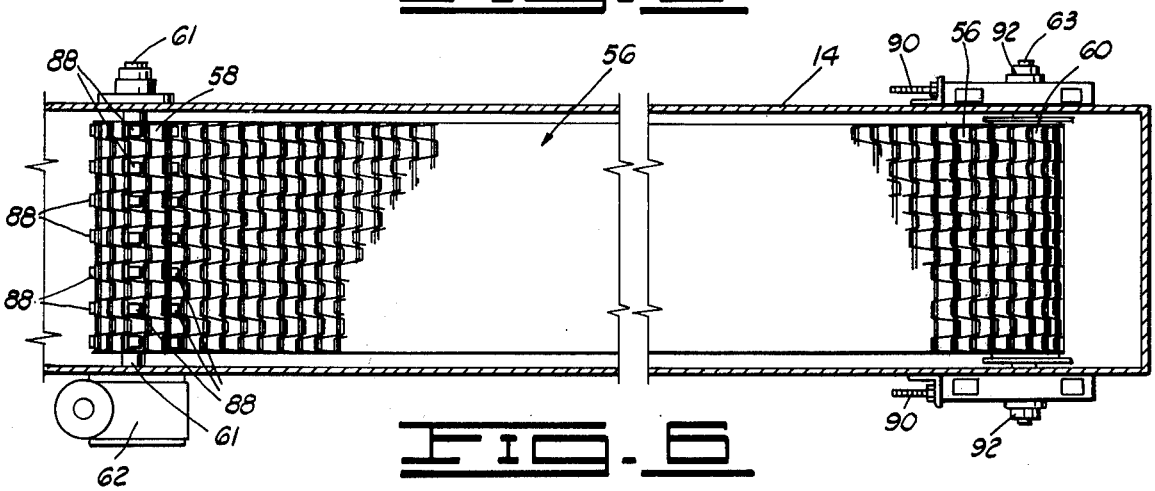
FIG. 6 is a cutaway sectional top view of an endless conveyor.

In FIG. 6, a top sectional view of the hopper housing 14 can be seen exposing the conveyor 56. In this view the conveyor 56 can be seen disposed at one end around the drive drum 58 having a plurality of outwardly extending teeth 88 disposed along the length of the drive drum 58. The drive drum 58 can be seen with the drive drum shaft 61 extending outwardly therefrom and connected to the gear box 62. At the other end of the conveyor 56 is the idle drum 60 with idle drum shaft 63. The tension on the conveyor 56 is adjusted by takeup bolts 90 which are attached to bearings 92 disposed around the ends of the idle shaft 63. By threading the bolts inwardly and outwardly, the tension on the conveyor 56 is adjusted.

Figure 7:
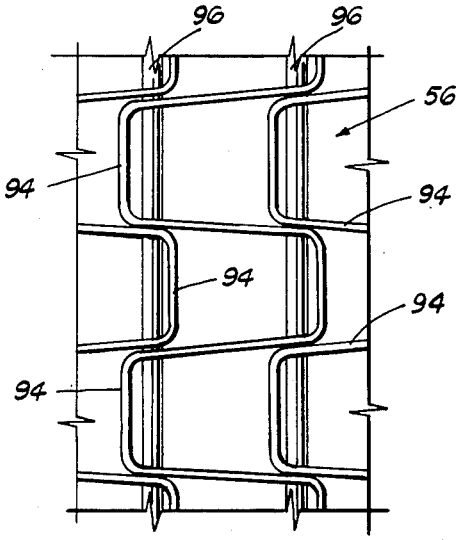
FIG. 7 is an enlarged sectional view of a portion of the conveyor.

In FIG. 7, an enlarged sectional view of the conveyor 56 is illustrated. The conveyor 56 is made up of a plurality of corrosion resistant links 94 forming an endless belt. The links 94 are joined together by laterally spaced link pins 96. The links 94 and link pins 96 are made of stainless steel or any other similar corrosion resistant material which will resist wear due to handling material such as salt, sand or the like. The link structure of the conveyor 56 is important in that the space between the links 94 provide room for receiving the outwardly extending teeth 88 which are spaced along the length of the drive drum 58. As the drive drum 58 rotates the teeth 88 are received between the links 94 thereby engaging the conveyor 56 and driving it therearound.

Figure 8:
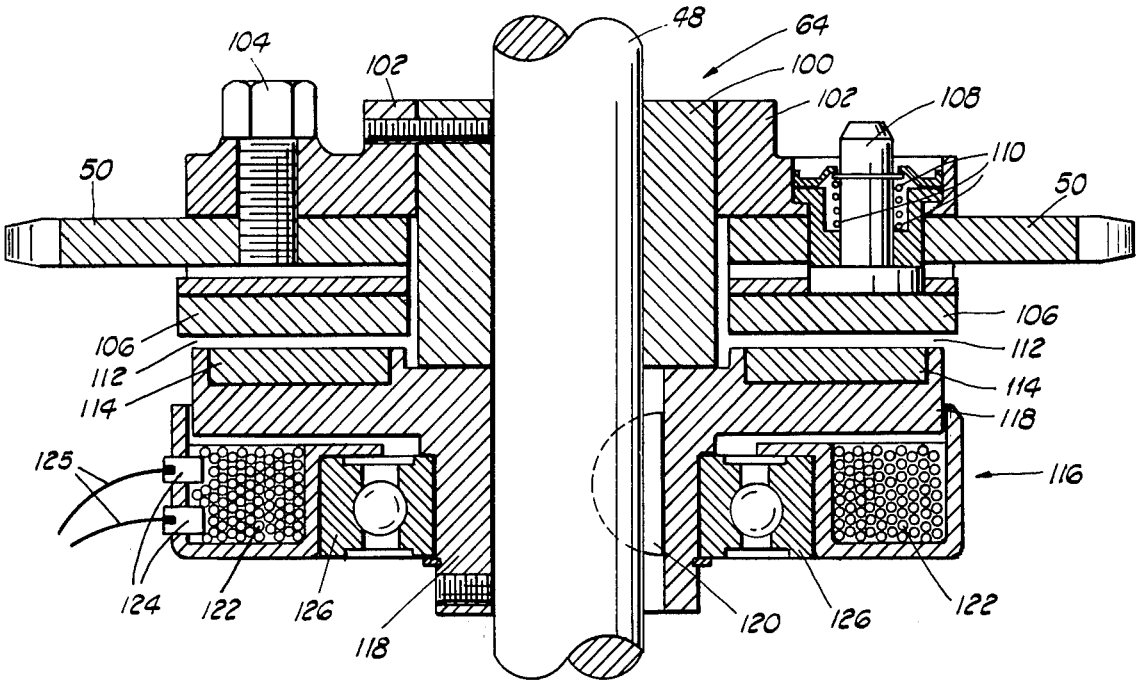
FIG. 8 is a sectional front view of a clutch assembly.

In FIG. 8, the structure of the clutch assembly 64 is illustrated. As mentioned under the discussion of FIG. 2, the clutch sprocket 50 is chain driven by the engine drive shaft 33 attached to the engine 31. The clutch sprocket 50 freewheels about the clutch shaft 48 on an oilite idle bearing 100. The bearing 100 is secured to a flange plate 102. The flange plate 102 is secured to the clutch sprocket 50 by a bolt 104. A moveable armature plate 106 is spring mounted to the clutch sprocket 50 by a pin 108 having a coil spring 110 mounted therearound and biasing the armature plate 106 upwardly.

In FIG. 8, the armature plate 106 is shown in an open position with an air gap 112 between the lower surface of the plate 106 and a rotor plate 114. The rotor plate is part of a solenoid assembly 116. The solenoid assembly 116 further includes a rotor hub 118 for housing the rotor plate 114. The rotor hub 118 is keyed to the clutch shaft 48 by a key 120. The clutch assembly 64 is actuated by energizing a coil 122 attached to electrical terminals 124. The electrical terminals 124 include electrical leads 125 wired to the battery of the engine 31 or any other electrical source. The coil 122 is mounted on a ball bearing 126 which freely rotates about the rotor hub 118. When the coil 122 is energized, a magnetic field is applied to the rotor plate 114 drawing downwardly the spring biased armature plate 106 thereby engaging the clutch sprocket 50 to the solenoid assembly 116 and rotating the clutch sprocket 50 on the clutch shaft 48.

When the coil 122 of the solenoid assembly 116 is de-energized, the spring 110, which is being held in tension, biases the armature plate 106 upwarding thereby disengaging the plate 106 from the rotor hub 114. At this time the air gap 112 is again formed and the sprocket 50 freewheels about the clutch shaft 48.

Figure 9:
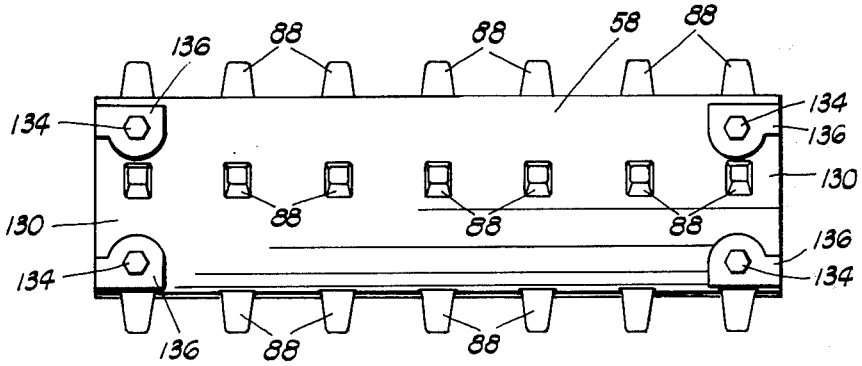
FIG. 9 is a front view of a drive drum.

In FIG. 9, a front view of the drive drum 58 is illustrated. The drive drum 58 is shown having a pair of annular shaped split drum plates 130 and 132. The drum plates 130 and 132 can be seen in an end view in FIG. 10. The split drum plates are secured to each other by a plurality of bolts 134, positioned inside bolt pockets 136 which are formed in the ends of the drum plates 130 and 132. The drum plates 130 and 132 are characterized by a plurality of the teeth 88, disposed along the length of the drum 58 and in a spaced relationship to each other.

Figure 10:
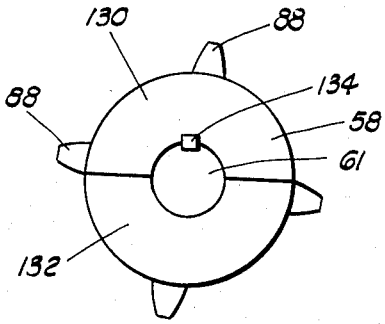
FIG. 10 is an end view of the drive drum.

In FIG. 10, the drum plates 130 and 132 can be seen attached to the drive drum shaft 61 by a key 138. The idle drum 60 is similar to the drive drum 58 except the idle drum 60 does not have any outwardly extending teeth 88. Due to handling corrosive material such as salt, the drive drum 58 often becomes rusted and corroded making it difficult to remove from the drive drum shaft 61. By using split drum plates 130 amd 132, the plates can be quickly removed from the shaft 61 by loosening the bolts 134. The plates 130 and 132 and shaft 61 can then be cleaned and reconditioned for reuse.

Changes may be made in the construction or arrangement of the parts or elements of the embodiments as disclosed herein without departing from the spirit or scope of the invention as defined in the following claims.

I claim:

1. A material spreader for mounting on a vehicle, the spreader comprising:

a hopper mounted in a hopper housing for storing the material therein, said hopper housing adapted for mounting on the rear of the vehicle;

an endless linked conveyor belt disposed at the bottom of said hopper for receiving the material thereon and discharging it out the rear of an opening in said hopper housing;

an idle drum and a drive drum attached to the sides of said hopper housing, said idle drum mounted at one end of said conveyor belt, said drive drum mounted at the other end of said conveyor belt, said drive drum and said idle drum including drum shafts with annular shaped split drum plates received around said shafts and attached thereto, said split drum plates of said drive drum including teeth extending outwardly therefrom and disposed in a spaced relationship along the length of said drum plates, said teeth engaging said linked conveyor belt and driving said belt thereon;

a material shoot attached to the rear of said hopper housing for receiving the material from the end of said conveyor belt;

a spinner assembly attached to the rear of said hopper housing and vertically disposed in said material shoot for spreading the material;

drive means mounted on said hopper housing for driving said conveyor belt and said spinner assembly; and clutch means attached to said drive means, said clutch means releasably engaging said conveyor belt and said spinner assembly.

2. The spreader as described in claim 1, wherein said drive means is a variable speed engine having a drive shaft, said clutch means chain driven by said drive shaft.

3. The spreader as described in claim 2, wherein said clutch means includes a clutch assembly having a clutch sprocket and a clutch shaft, clutch sprocket rotating said clutch shaft when a solenoid assembly attached to said clutch shaft is energized.

4. The spreader as described in claim 3, wherein said clutch assembly further includes a spinner drive sprocket attached to said clutch shaft, said spinner assembly chain driven by said spinner drive sprocket.

5. The spreader as described in claim 4 further including a drive gear box attached to said clutch shaft and said conveyor belt for reducing the speed of said clutch shaft to said conveyor.

6. The spreader as described in claim 1 further including a conveyor gate assembly mounted in the rear of said hopper and disposed above the top of said conveyor, by raising and lowering said gate assembly the amount of material discharged on the conveyor belt is controlled.

7. The spreader as described in claim 1, further including a baffle assembly attached to the bottom of said shoot, said baffle assembly having a baffle frame disposed around the opening in said shoot and pivotly mounted baffle plates attached to said baffle frame, said baffle plates controlling the spread of the material as the material is discharged from said spinner assembly.

8. A material spreader for mounting on a vehicle, the spreader comprising:

a hopper mounted in a hopper housing for storing the material therein, said hopper housing adapted for mounting on the rear of the vehicle;

an endless linked conveyor belt disposed at the bottom of said hopper for receiving the material thereon and discharging out the rear of an opening in said hopper housing;

an idle drum and a drive drum attached to the sides of said hopper housing, said idle drum mounted at one end of said conveyor belt, said drive drum mounted at the other end of said conveyor belt, said idle drum and said drive drum having drum shafts with annular shaped split drum plates received around said shafts and attached thereto, said split drum plates of said drive drum including teeth extending outwardly therefrom and disposed in a spaced relationship along the length of said drum plates, said teeth engaging said conveyor belt and driving said belt thereon;

a material shoot attached to the rear of said hopper housing and extending downwardly therefrom, said material shoot receiving the material from one end of said conveyor belt;

a spinner assembly attached to the rear of said hopper housing and disposed vertically inside said material shoot for receiving the material from said shoot and spreading the material therefrom;

a variable speed engine mounted on the rear of said hopper housing;

a clutch assembly attached to the rear of said hopper housing and driven by said engine, said clutch assembly electrically actuated for engaging and disengaging a clutch shaft, said clutch shaft attached to said spinner assembly for driving said spinner assembly; and a drive gear box attached to said clutch shaft and said drive drum shaft, said clutch shaft driving said drive drum shaft through said gear box.

* * * * *